US008931675B2

(12) United States Patent
Bentchev et al.

(10) Patent No.: US 8,931,675 B2
(45) Date of Patent: Jan. 13, 2015

(54) WEB HANDLING SYSTEM AND VACUUM ROLLER FOR USE IN CONJUNCTION THEREWITH

(75) Inventors: Dimitar B. Bentchev, Norwood, MA (US); John S. Berg, Franklin, MA (US)

(73) Assignee: Carpe Diem Technologies, Inc., Franklin, MA (US)

( * ) Notice: Subject to any disclaimer, the term of this patent is extended or adjusted under 35 U.S.C. 154(b) by 415 days.

(21) Appl. No.: 13/368,804

(22) Filed: Feb. 8, 2012

(65) Prior Publication Data

US 2013/0200127 A1 Aug. 8, 2013

(51) Int. Cl.
*B65H 20/12* (2006.01)

(52) U.S. Cl.
CPC ..... *B65H 20/12* (2013.01); *B65H 2555/13* (2013.01)
USPC ..... 226/95

(58) Field of Classification Search
CPC .... B65H 20/12; B65H 2555/13; B65H 5/226; B65H 7/16; B65H 29/243; B65H 2406/36; B65H 2406/361
USPC ..... 226/93, 95; 271/108, 276, 194, 196
See application file for complete search history.

(56) References Cited

U.S. PATENT DOCUMENTS

| | | | | |
|---|---|---|---|---|
| 4,277,010 | A | 7/1981 | Landskroener et al. | |
| 6,641,513 | B1 | 11/2003 | Ward et al. | |
| 7,654,427 | B1 * | 2/2010 | Tsai et al. | 226/95 |
| 7,708,176 | B2 * | 5/2010 | Chuang et al. | 226/20 |
| 2006/0261120 | A1 * | 11/2006 | Slyne | 226/95 |

* cited by examiner

*Primary Examiner* — William E Dondero
(74) *Attorney, Agent, or Firm* — Kriegsman & Kriegsman

(57) ABSTRACT

A vacuum roller for a web handling system comprises a hollow, cylindrical, rotably driven drum and an end cap threadingly mounted onto the rear end of the drum. Together, the drum and the end cap define a plurality of individual, externally communicable vacuum paths. A spherical, metal movable element is internally disposed within each vacuum path and regulates the passage of air therethrough. A plurality of magnetic elements is fixedly mounted on a stationary annular holder. In use, each magnetic element selectively displaces each movable element when disposed in close proximity thereto to the extent necessary so as to permit the passage of air through its corresponding vacuum path. As such, the vacuum roller is provided with a predefined range of suction, or vacuum zone, about the outer surface of its rotating drum that directly corresponds to the angular arrangement of the plurality of stationary magnetic elements.

14 Claims, 18 Drawing Sheets

WEB HANDLING SYSTEM AND VACUUM ROLLER FOR USE IN CONJUNCTION THEREWITH

FIELD OF THE INVENTION

The present invention relates generally to web handling technologies and more particularly to web handling systems that include one or more vacuum rollers.

BACKGROUND OF THE INVENTION

In many manufacturing applications, a continuous web is utilized as a substrate onto which is deposited at least one layer, the web being commonly constructed out of a thin, flexible material, such as paper, plastic, foil, glass or a composite thereof. For example, one or more layers of film are commonly deposited, etched, embossed and/or printed onto a common web of thin, flexible material to produce one or more nanoelectronic devices.

Web handling systems are well known in the art and are commonly used to transport, redirect or otherwise handle various types and thicknesses of webs throughout a manufacturing process. Web handling systems often rely upon nip, or pinch, rollers to transport webs of material between processing stations. Pinch rollers typically include a pair of rotating wheels that are adapted to selectively engage opposing sides of the web.

In certain manufacturing applications, one surface of the web may be sensitive to contact. For instance, one surface of the web may be coated, embossed or printed thereon and, as such, requires transport without direct contact for a specified period of time. In this circumstance, web handling systems that rely upon opposing surface contact are undesirable for use.

Accordingly, vacuum drive rollers (also commonly referred to simply as vacuum rollers) are well known in the art and are widely used in web handling systems that require no-slip, speed variable, web transport using contact against only one side of the web. One type of vacuum roller which is well known in the art includes a hollow rotating drum that is provided with a pattern of holes formed in a peripheral surface thereof. A vacuum pump is coupled to the drum that is in direct communication with each of the externally-accessible holes. In this manner, activation of the vacuum pump serves to create continuous suction through each of the holes in the periphery of the drum that, in turn, allows for grasping and transporting of the web.

As can be appreciated, the use of vacuum rollers in web handling systems is desirable in that a web of material can be transported, redirected or otherwise handled through contact with only one side. In addition, by adjusting the torque applied by the roller, isolated variance in the tension of the web can be achieved. As can be appreciated, controlling, or isolating, web tension is critical in various web-based manufacturing processes, such as coating, drying, etching and laminating. Large tension differentials can be achieved throughout various zones of a single web line by either rapidly advancing the web or, by contrast, pulling the web slower.

Although well known and widely used in the art, conventional vacuum rollers have been found to suffer from a notable disadvantage. Specifically, conventional vacuum rollers are designed to provide suction about the entire periphery of its drum (i.e., a full 360 degrees). However, in most traditional web handling systems, a vacuum roller only requires an angular region of contact, or vacuum zone, which is a fraction of its entire periphery. In other words, the web being transported by the roller overlies a limited number of the vacuum channels at any given moment in time. With the majority of the vacuum channels rendered exposed to the immediate atmospheric environment, an exceptionally large vacuum flow capacity is required to achieve vacuum force to effectively draw the web firmly against the roller surface. Due to the inefficient nature of this construction, a considerable amount of power is utilized and wasted, which is highly undesirable.

In response thereto, vacuum rollers have been designed to create a vacuum zone that extends over a limited, predefined angular region of its outer periphery (e.g., over a specified 45 degree region). For example, in U.S. Pat. No. 4,277,010 to P. A. Landskroener et al., the disclosure of which is incorporated herein by reference, there is disclosed a vacuum roller for transporting a web that includes a hollow rotatable cylinder, or drum, with a plurality of longitudinally-extending, externally communicable vacuum channels spaced circumferentially about its entire outer periphery. A separate wear plate is fixedly attached to the rear end of the cylinder and includes a circumferential array of circular bores, each bore aligned in direct communication with a corresponding vacuum channel in the drum. A stationary sealing ring is disposed firmly against the rear surface of the wear plate by springs and is shaped to include at least one arcuate opening that is in communication with a predefined number of vacuum channels formed in the cylinder. Accordingly, as the drum rotates about its longitudinal axis during normal operation, a web disposed in close proximity thereto will only be drawn against the specific vacuum channels that occupy angular positions in direct alignment within the arcuate opening in the sealing ring. In this capacity, the sealing ring serves as a baffle that limits vacuum forces applied by the rotating cylinder along a fixed angular region, or wrap angle.

Although well known and widely used in the art, the use of externally mounted sealing rings or other similarly operating components have been found to introduce a couple of notable shortcomings.

As a first shortcoming, the continuous friction experienced between the stationary sealing ring and the rotating wear plate not only results in significant wear and tear of the components over time but also tends to create fragmentary debris. It should be noted that dirt, dust or other similar forms of debris can, in turn, be drawn directly into the vacuum path, thereby resulting in clogging of selected vacuum channels and/or damage to the web being transported by the vacuum roller, both of which are highly undesirable.

As a second shortcoming, the effectiveness of the actual seal between the ring and the wear plate for the vacuum roller is rather limited in nature, thereby resulting in the leakage of air therebetween. As a result such, the energy efficiency of such a construction has been found to be unsatisfactory.

BRIEF SUMMARY OF THE INVENTION

It is an object of the present invention to provide a new and improved vacuum roller for a web handling system.

It is another object of the present invention to provide a vacuum roller of the type described above that includes a hollow rotatable drum that is shaped to define a plurality of spaced apart, externally communicable vacuum paths.

It is yet another object of the present invention to provide a vacuum roller of the type described above that can be configured to limit vacuum forces within a predefined, modifiable angular region about its periphery by selectively regulating air flow through the plurality of vacuum paths.

It is yet still another object of the present invention to provide a vacuum roller of the type described above that is energy efficient.

It is another object of the present invention to provide a vacuum roller of the type described above wherein the hollow drum experiences limited frictional forces during its rotation.

It is still another object of the present invention to provide a vacuum roller of the type as described above that has a limited number of parts, is inexpensive to manufacture and is easy to use.

Accordingly, as a principal feature of the present invention, there is provided a vacuum roller for a web handling system comprising (a) a drum, the drum having an inner surface, an outer surface, a front end and a rear end, the drum being shaped to at least partially define a plurality of externally communicable vacuum paths, and (b) a plurality of movable elements, each movable element being disposed within an associated vacuum path and serving to regulate the passage of air therethrough.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Web Handling System 11

Figure 1:
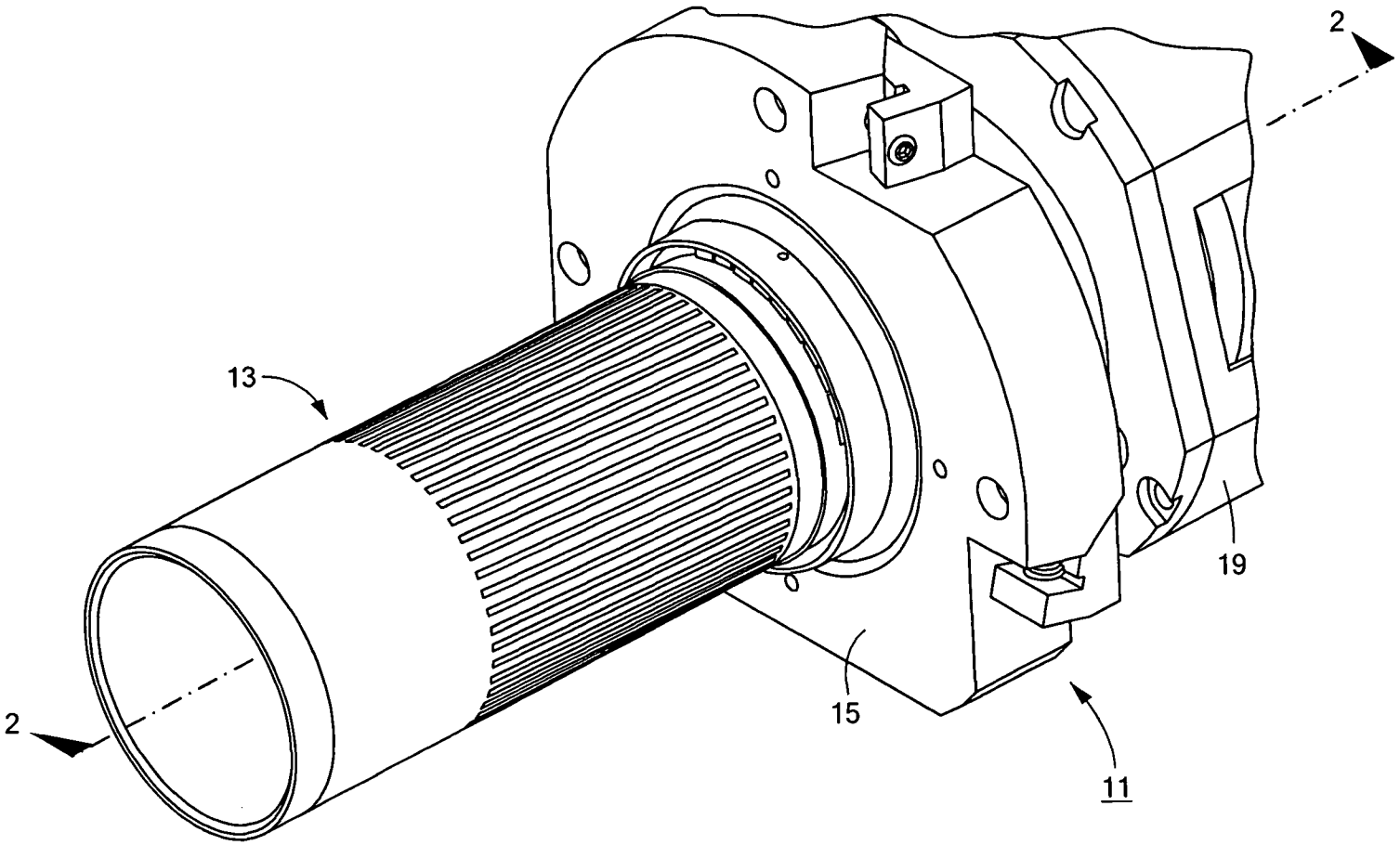
FIG. 1 is a fragmentary, top perspective view of a web handling system constructed according to the teachings of the present invention.
Figure 2:
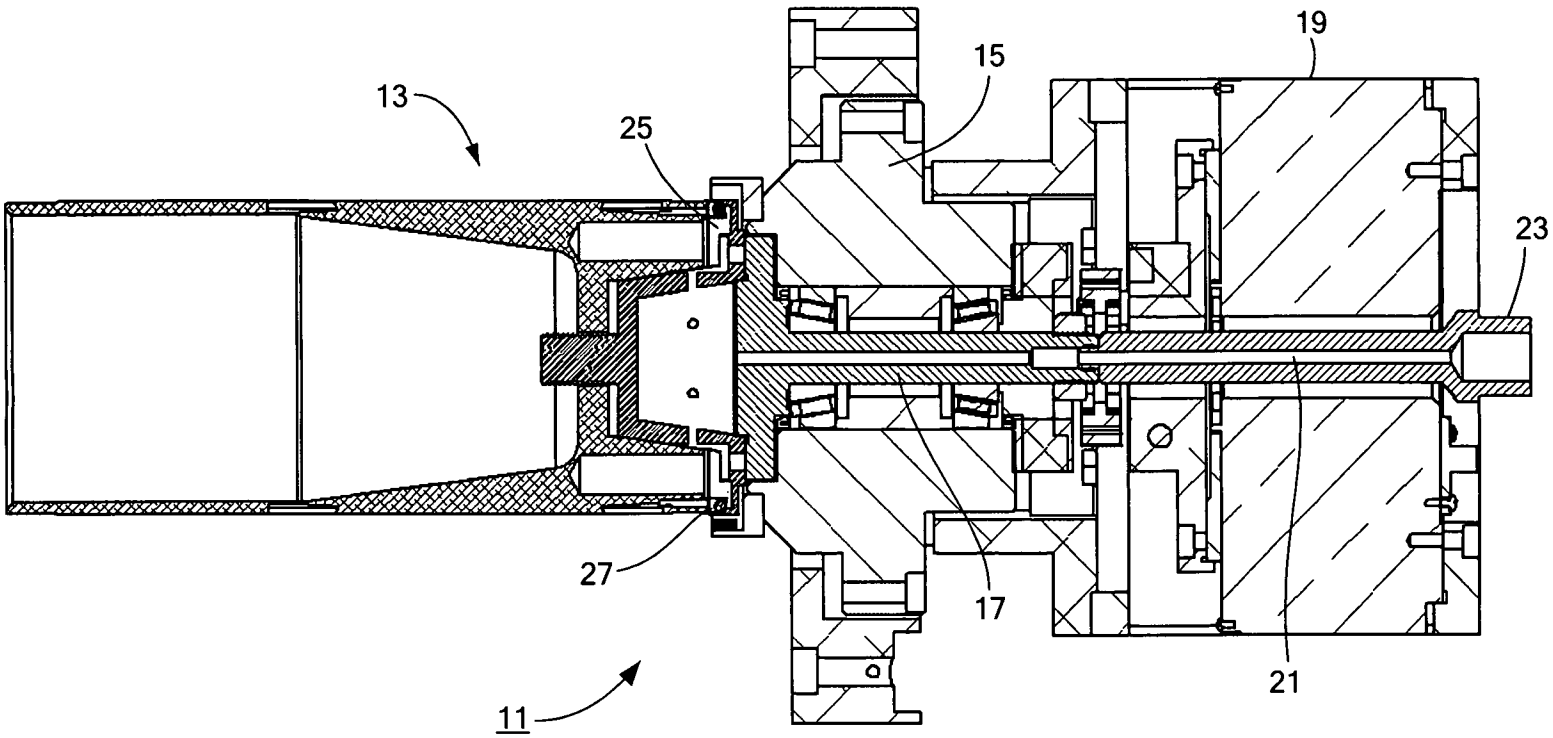
FIG. 2 is a section view of the web handling system shown in FIG. 1, taken along lines 2-2.

Referring now to FIGS. 1 and 2, there is shown a web handling system that is constructed according to the teachings of the present invention, the web handling system being identified generally by reference numeral 11. In use, system is designed to transport, redirect or otherwise handle a web of material by applying a vacuum force to one of its surfaces.

For simplicity purposes only, system 11 will be described herein as being used in connection with the transport of a thin, flexible web of material, such as a 40-50 micron thick plastic film. However, it should be noted that system 11 is not limited for use in the transportation of any particular type or thickness of material. Rather, it is to be understood that system 11 could be used to handle a wide array of types and thicknesses of web-based materials without departing from the spirit of the present invention.

Web handling system 11 comprises a vacuum roller 13, a front mounting plate 15 to which vacuum roller 13 is coupled, a main drive shaft 17 fixedly connected at one end to vacuum roller 13 and a motor 19 for rotatably driving main drive shaft 17. As seen most clearly in FIG. 2, main drive shaft 17 is shaped to define a longitudinally extending vacuum line 21 in direct communication with vacuum roller 13. The free end of main drive shaft 17 is provided with a fitting 23 for removable connection to a vacuum pump (not shown). Accordingly, upon activation of the vacuum pump, a vacuum pathway is established through line 21 that is disposed in communication with vacuum roller 13. In this manner, vacuum roller 13 is provided with the necessary suction to grasp and transport the desired web of material.

It should be noted that the particular construction of vacuum roller 13 serves as the principal novel feature of web handling system 11. As will be described further in detail below, vacuum roller 13 is shaped to define a plurality of individual, externally communicable vacuum paths 25 which are in communication with the vacuum pump. In addition, vacuum roller 13 includes a plurality of internal valves 27, each valve 27 being disposed within an associated vacuum path 25 and functioning, inter alia, to selectively regulate the flow of air therethrough. In this capacity, internal valves 27 enable vacuum roller 13 to be configured to limit vacuum forces to a predefined angular region about its periphery, which is a principal object of the present invention.

Vacuum Roller 13

Figure 3:
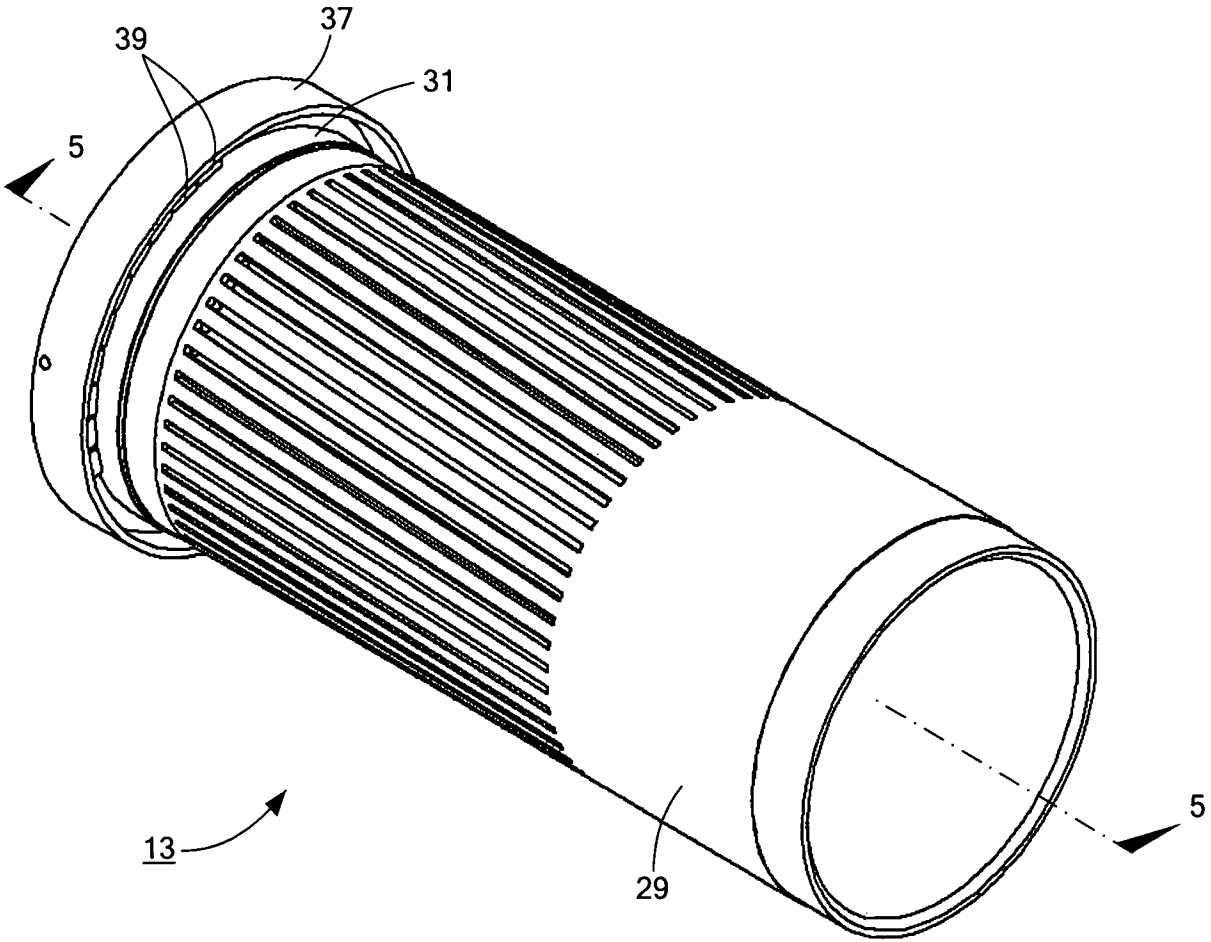
FIG. 3 is a top perspective view of the vacuum roller shown in FIG. 1.
Figure 4:
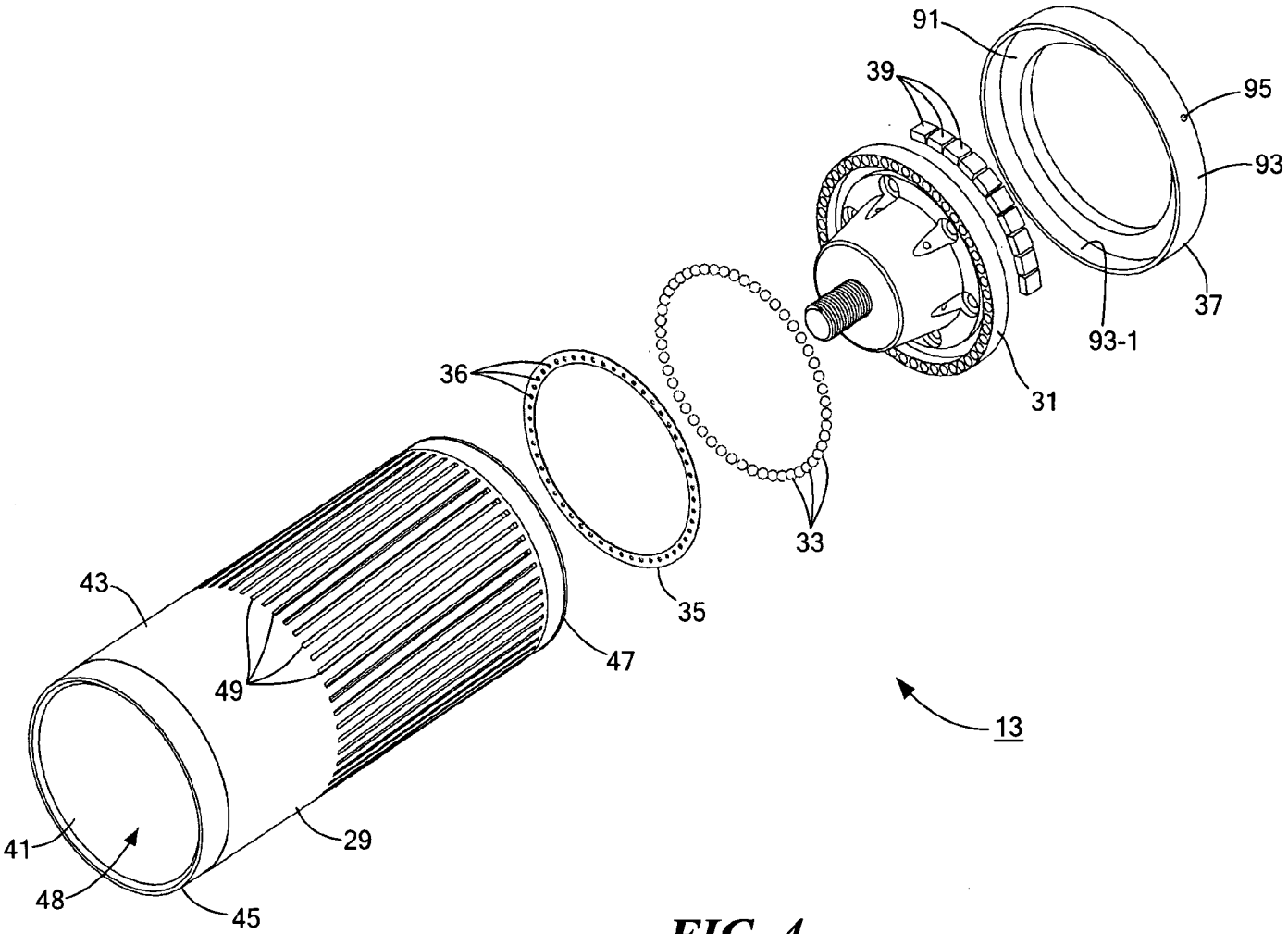
FIG. 4 is an exploded, top perspective view of the vacuum roller shown in FIG. 3.
Figure 5:
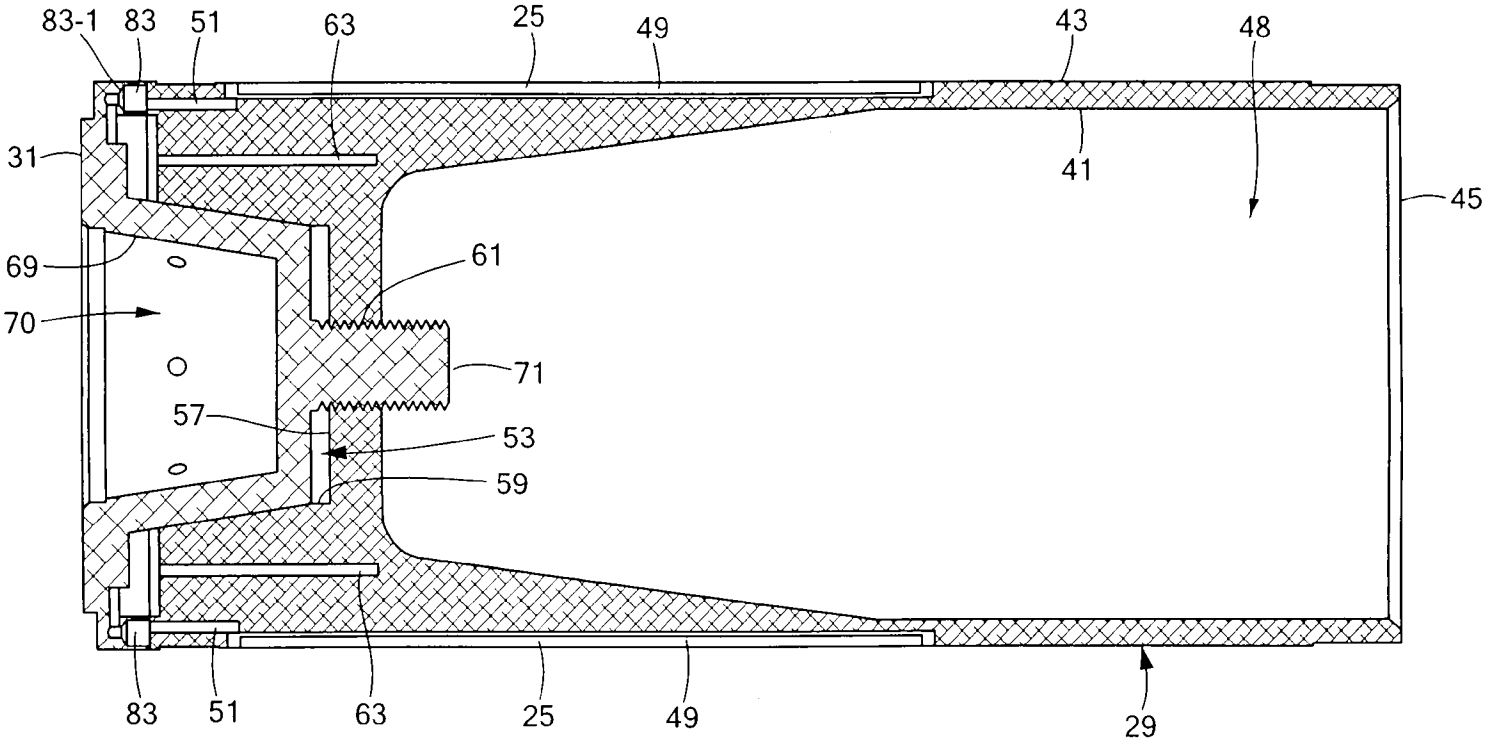
FIG. 5 is a section view of the roller drum shown in FIG. 3, taken along lines 5-5, the drum being shown with its associated end cap mounted thereon.
Figure 7:
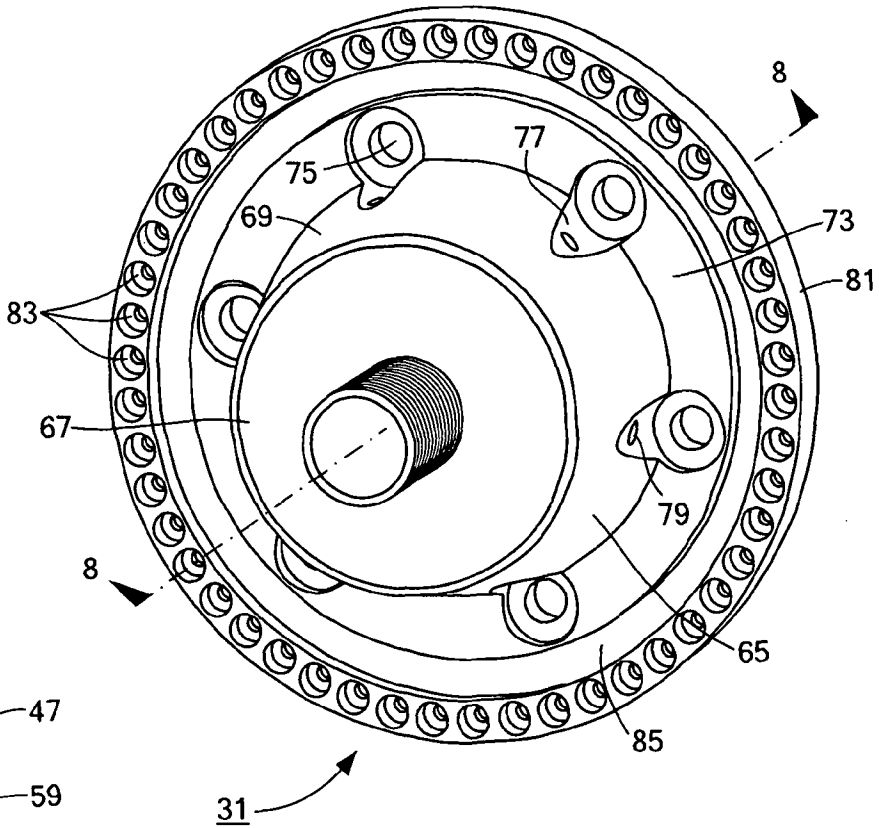
FIG. 7 is a front perspective view of the end cap shown in FIG. 4.

Referring now to FIGS. 3-5, vacuum roller 13 comprises a hollow drum 29, an end cap 31 threadingly mounted onto the rear end of drum 29, a plurality of closing members 33 mounted in end cap 31, an annular gasket 35 affixed to end cap 31 for retaining closing members 33 therein, an annular holder 37 surrounding end cap 31 in a spaced apart relationship relative thereto, and a plurality of magnetic elements 39 mounted on holder 37 for selectively regulating the position of closing members 33, as will be described in detail below.

Figure 6:
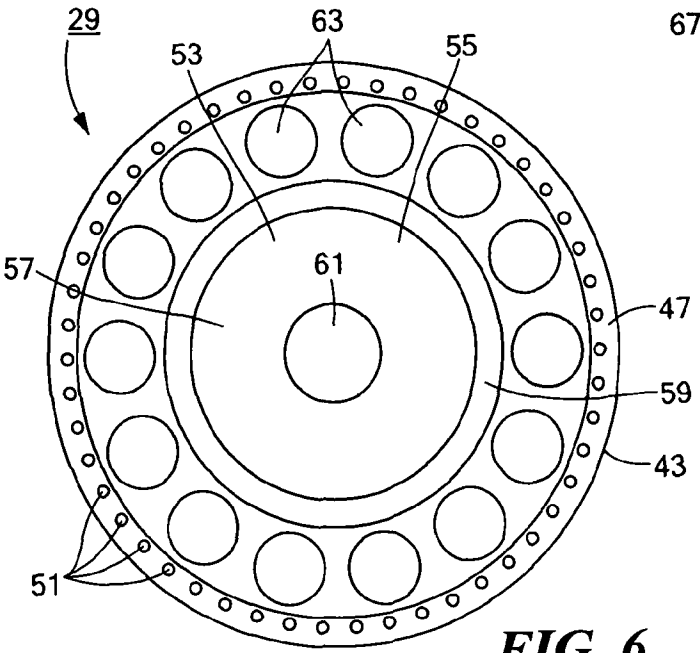
FIG. 6 is a rear plan view of the roller drum shown in FIG. 1.

As seen most clearly in FIGS. 4-6, drum, or shell, 29 is an elongated, hollowed, generally cylindrical member that is preferably constructed of a rigid and durable material, such as a lightweight metal. Drum 29 includes an interior surface 41, a rounded exterior surface 43, a substantially open front end 45 and a substantially enclosed rear end 47 that together define an enlarged interior cavity 48.

A plurality of slightly curved, longitudinally extending vacuum channels 49 are formed into exterior surface 43 in an equidistantly spaced apart relationship. Each vacuum channel 49 is generally rectangular in transverse cross-section along the entirety of its length and, as such, provides a uniformly distributed suction force, which is highly desirable.

It should be noted that the slight curve, or spiral, of each vacuum channel 49 creates a gradual, or tapered, suction force across the width of a web transported by drum 29 during normal operation, which is highly desirable. In a similar capacity, the spiral of each vacuum channel 49 creates a gradual, or tapered, release of a web transported by drum 29, thereby limiting the stress applied thereto.

It should also be noted that drum 29 is not limited to any particular length, cross-section or configuration of its vacuum channels 49. Rather, it is to be understood that the particular design of vacuum channels 49 could be modified without departing from the spirit of the present invention, as will be described further in detail below.

As seen most clearly in FIGS. 5 and 6, a circumferential array of equidistantly spaced apart, generally circular bores 51 is formed into rear end 47 directly beneath exterior surface 43. It is important to note that each bore 51 communicates with the rear end of a corresponding vacuum channel 49. Accordingly, the application of a vacuum force to each bore 51, in turn, creates suction through its corresponding vacuum channel 49, as will be described further below.

An enlarged, inwardly tapered central recess 53 is formed into rear end 47 so as to define a funnel-shaped support member 55, support member 55 comprising a transverse interior wall 57 and a continuous, tapered sidewall 59. A threaded longitudinal bore 61 extends through the center of interior wall 57 and is adapted to receive end cap 31, as will be described further below.

Preferably, a circumferential array of fourteen, equidistantly spaced apart bores 63 is formed into rear end 47 between outer ring of bores 51 and central recess 53, each bore 63 having an enlarged circular shape in transverse cross-section. As can be appreciated, the inclusion of bores 63 renders drum 29 both lightweight and inexpensive to manufacture (due to the reduction of shell material required).

As noted briefly above, end cap 31 is a unitary member that is removably mounted onto rear end 47 of cylindrical drum 29. Together, end cap 31 and drum 29 define the plurality of individual, externally communicable vacuum paths 25 that are independently regulated by corresponding valves 27, as will be described further below.

As seen most clearly in FIGS. 4, 5, 7 and 8, end cap 31 includes a cup-shaped base 65 comprising an enclosed circular end wall 67 and a continuous, outwardly tapered sidewall 69 that extends rearwardly about the periphery of end wall 67. Together, end wall 67 and sidewall 69 define an enlarged interior cavity 70, the function of which will become apparent below. A bolt-type threaded fastener 71 projects orthogonally out from the front surface 67-1 of end wall 67 and is dimensioned for threaded engagement within bore 61 formed in interior wall 57, as shown in FIG. 5. In this capacity, end cap 31 is adapted to be easily removably mounted onto rear end 47 of drum 29 through a screw-type engagement, with base 65 dimensioned such that the outer surface of sidewall 69 lies flush against the inner surface of sidewall 59 in drum 29 so as to prevent passage of air therethrough.

An outwardly extending, annular flange 73 is formed about the periphery of the rear end of sidewall 69, flange 73 having a front surface 73-1 and a rear surface 73-2. A circular array of countersunk thru-holes 75 is formed into front surface 73-1 of flange 73 in an equidistantly spaced apart relationship, each thru-hole 75 being circular in transverse cross-section. As will be described further below, each thru-hole 75 is adapted to receive a screw or other similar fastening element that is in turn driven into threaded engagement with the front end of main shaft 17. Accordingly, it is to be understood that, with system 11 in it its assembled form, the axial rotation of main shaft 17 results in the axial rotation of end cap 31 and, in turn, hollow drum 29.

To facilitate rearward insertion of each fastening element through thru-hole 75, outer surface 69-1 of sidewall 69 is provided with a plurality of inwardly curved longitudinal grooves 77, each groove 77 extending in communication with a corresponding countersunk thru-hole 75. A small transverse hole 79 is formed in sidewall 69 within each groove 77, the function of holes 79 to become apparent below.

An annular collar 81 is formed onto the outer periphery of flange 73 and projects in a forward relationship relative thereto. It should be noted that front surface 73-1 of flange 73 is shaped to include an annular recess 85 about its outer periphery at the junction with collar 81, recess 85 forming an undercut 87 beneath collar 81, as seen most clearly in FIG. 8.

A circumferential array of equidistantly spaced apart, axial bores 83 is formed into front surface 81-1 of collar 81. With vacuum roller 13 fully assembled, each axial bore 83 in collar 81 aligns with a corresponding bore 51 in drum 29 so as to establish fluid communication therebetween, as seen most clearly in FIG. 5.

Figure 8:
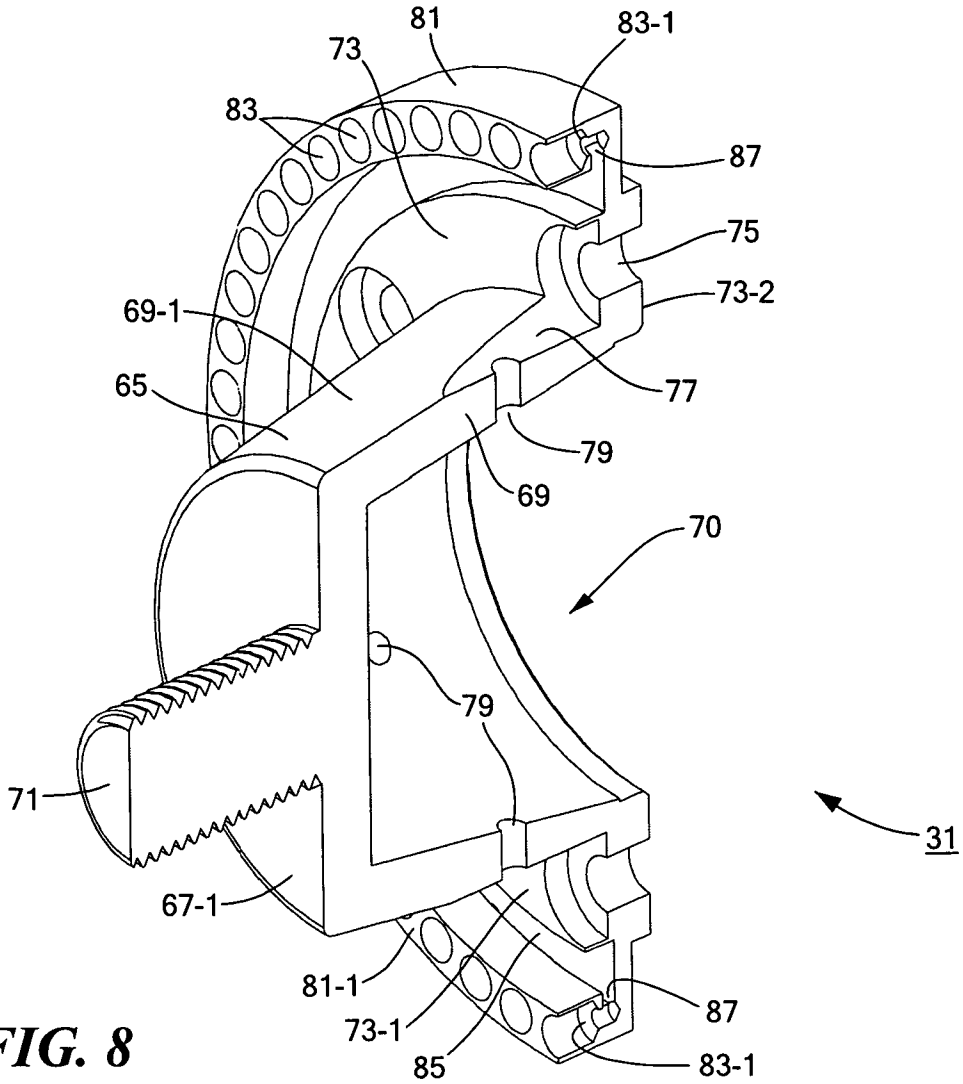
FIG. 8 is a perspective section view of the end cap shown in FIG. 7, taken along lines 8-8.

Each axial bore 83 is generally circular in transverse cross-section and terminates into inwardly tapered, reduced diameter seat, or neck, 83-1, as seen most clearly in FIG. 8. As will be described further below, each axial bore 83 is adapted to receive a corresponding closing member 33. Together, each seat 83-1 and its associated closing member 33 form a valve 27 that is used, in turn, to regulate air flow through its corresponding vacuum channel 49.

As noted briefly above, a plurality of closing members 33 is mounted in end cap 31. More specifically, each closing member 33 is disposed within a corresponding bore 83 in end cap 31 and is retained therein by affixing annular silicone gasket 35 against front surface 81-1 of collar 81 (e.g., using a pressure sensitive adhesive-backed gasket), gasket 35 being shaped to include a plurality of reduced-diameter holes 36 to permit the passage of air therethrough its corresponding vacuum path 25. By fixedly retaining closing members 33 within end cap 31, gasket 35 simplifies the process of assembling vacuum roller 13, which is highly desirable.

Preferably, each closing member 33 is in the form of a metal sphere that is dimensioned to selectively enclose a corresponding seat 83-1 in end cap 31. In this capacity, it is to be understood that together seat 83-1 and closing member 33 form a ball check valve 27. However, it should be noted that vacuum roller 13 is not limited to spherical closing members 33. Rather, it is to be understood that each closing member 33 could be alternatively configured to selectively enclose seat 83-1 (e.g., as a pivotable flap) without departing from the spirit of the present invention.

Referring back to FIGS. 3 and 4, holder 37 is preferably formed as a unitary member that is constructed of a rigid and durable material, such as steel. Holder 37 comprises a flat ring 91 and a thin collar 93 that is formed about the periphery of ring 91. A pilot hole 95 is preferably formed in collar 93 that is adapted to receive a pin or other similar fastening element (not shown). In this manner, the pin can be used to secure holder 37 to front mounting plate 15 in a fixed, stationary manner.

A plurality of magnetic elements 39 is magnetically coupled to the inner surface 93-1 of collar 93 in an end-to-end arrangement so as to form a continuous arcuate magnetic chain. Each magnetic element 39 is represented herein as a generally rectangular magnetic block. However, it is to be understood that the number, style, shape and arrangement of magnetic elements 39 could be modified without departing from the spirit of the present invention. As will be described in detail below, the selective regulation of valves 27 in vacuum roller 13 is achieved using magnetic elements 39.

Figure 9:
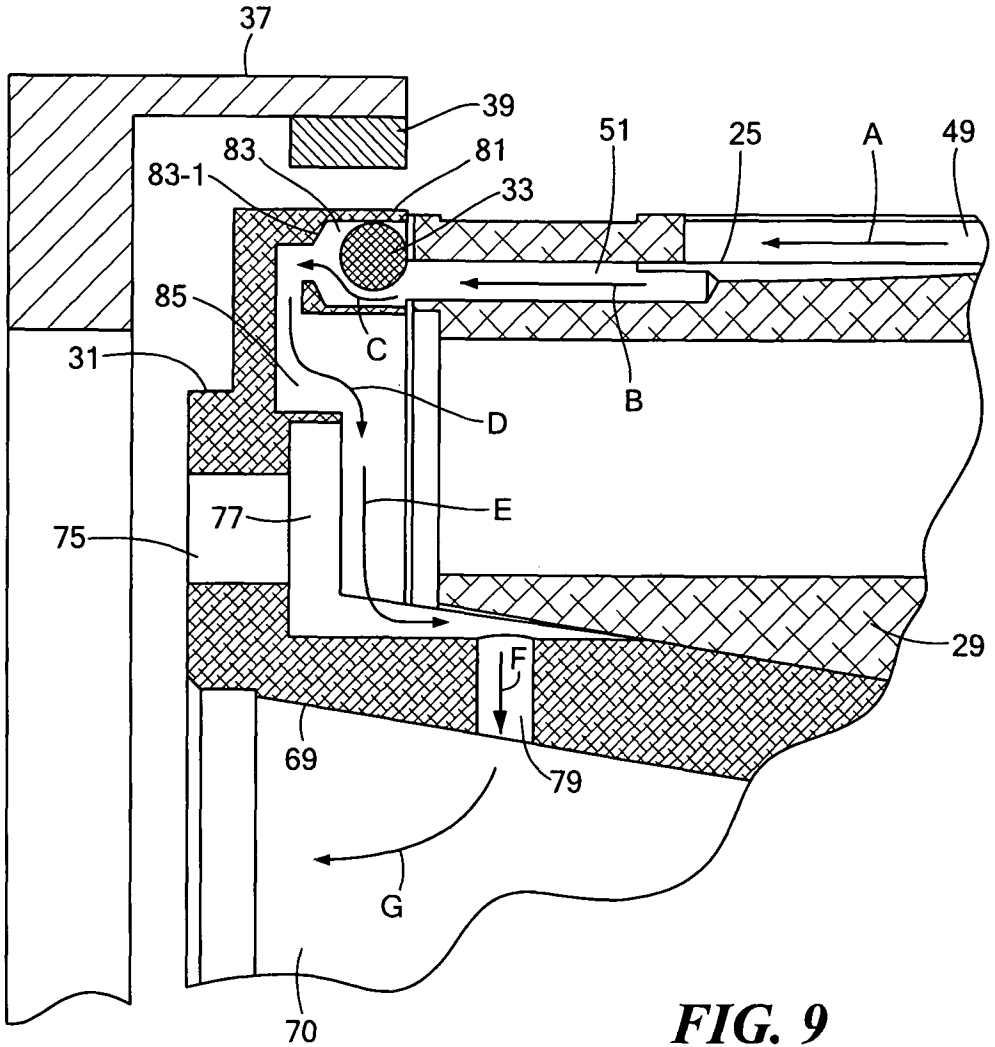
FIG. 9 is an enlarged, fragmentary, longitudinal section view of the vacuum roller shown in FIG. 3, the vacuum roller being shown with a magnet drawing the metal closing member away from its seat so as to permit the passage of air through the entirety of its corresponding vacuum path.

Specifically, with vacuum roller 11 in its assembled form, a plurality of independent vacuum paths 25 is established. As seen most clearly in FIG. 9, each vacuum path 25 extends from its externally communicable vacuum channel 49 (as represented by arrow A), through its corresponding bore 51 formed into the rear of drum 29 (as represented by arrow B), through its corresponding bore 83 in collar 81 (as represented by arrow C), within the gap, or spacing, between drum 29 and end cap 31 due to the presence of recess 85 (as represented by arrow D), along a close proximity groove 77 formed in sidewall 69 of end cap 31 (as represented by arrow E), through its corresponding hole 79 in sidewall 69 of end cap 31 (as represented by arrow F), and into interior cavity 70 (as represented by arrow G). In this manner, suction can be provided through each vacuum channel 49 by drawing air through interior cavity 70 (i.e., using cavity 70 as a common vacuum outlet).

Although not shown herein, it should be noted that the screw inserted through each thru-hole 75 that is in turn used to secure end cap 31 to main drive shaft 17 substantially encloses the thru-hole 75 to prevent the escape, or leakage, of air therethrough. It should also be noted that the countersunk nature of each thru-hole 75 ensures that the head of the screw extending therethrough does not impede the flow of air within vacuum path 25.

Figure 10:
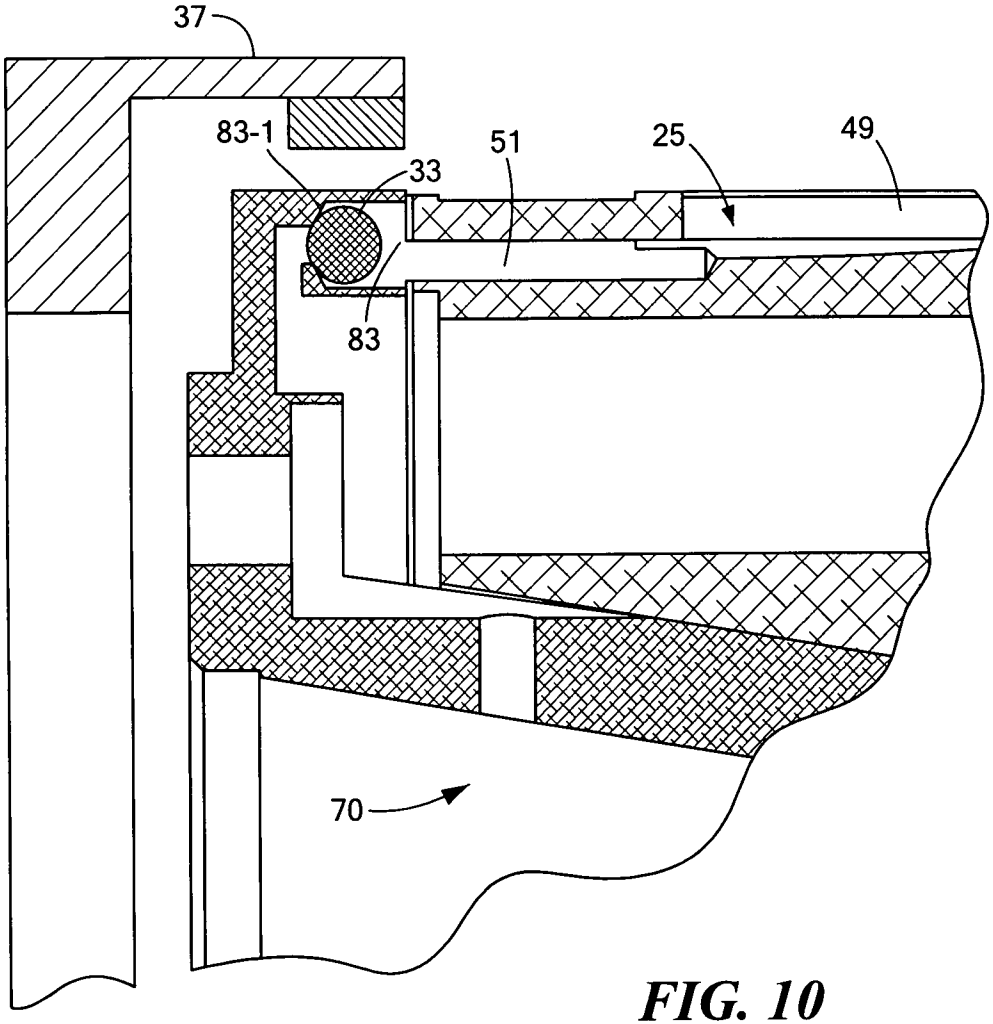
FIG. 10 is an enlarged, fragmentary, longitudinal section view of the vacuum roller shown in FIG. 3, the vacuum roller being shown with the metal closing member disposed in its seat so as to preclude the passage of air through the entirety of its corresponding vacuum path.

Due to the presence of a magnetic element 39 directly thereabove, spherical closing member 33 is magnetically drawn away from seat 83-1 to the extent that air can pass throughout vacuum path. However, in the absence of a magnetic element 39 directly thereabove, the application of a suction force through common cavity 70 pulls spherical closing member 33 firmly into seat 83-1, as shown in FIG. 10. The air-tight seal created with closing member 33 disposed within seat 83-1 serves to prevent the passage of air throughout the entirety of vacuum path 25. In this manner, the selective regulation of air flow through the various vacuum paths 25 can be achieved by arranging magnetic elements 39 in a particular configuration, as will be described further below.

Operation of Web Handling System

Figure 11:
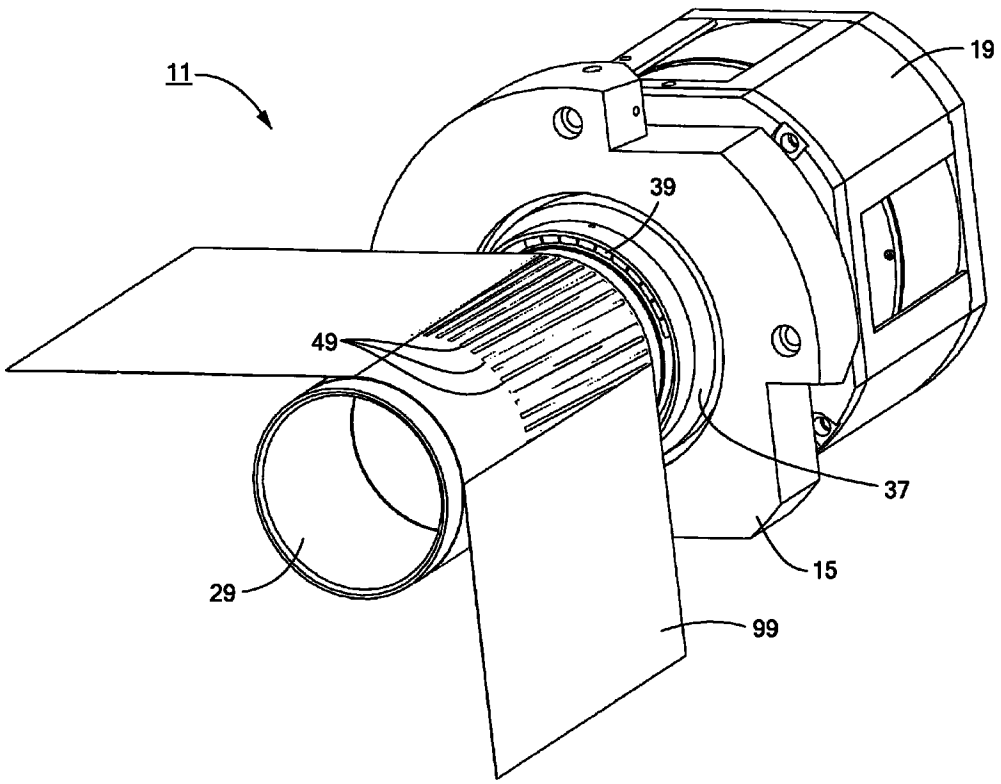
FIG. 11 is a top perspective view the web handling system shown in FIG. 1, the web handling system being shown transporting a web of material, the web being shown broken away in part for ease of illustration.
Figure 12:
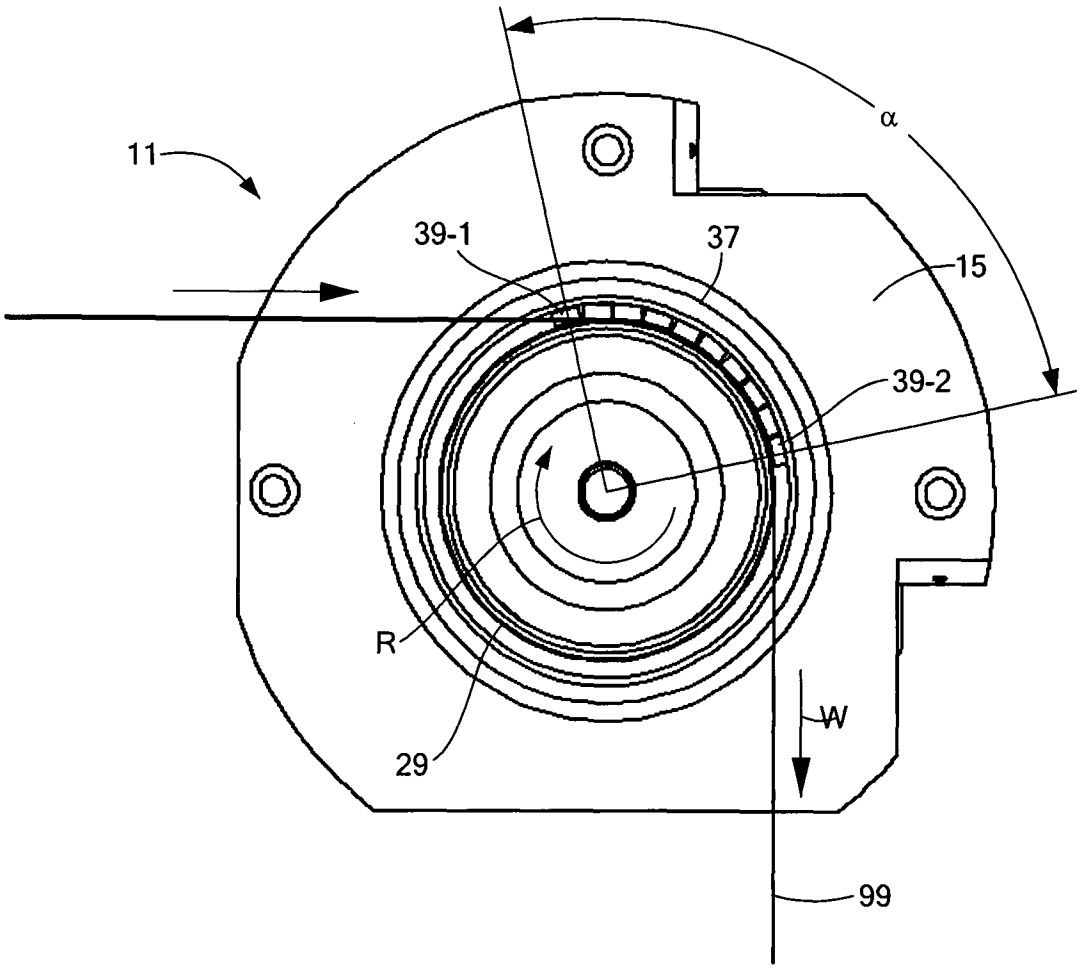
FIG. 12 is a front plan view of the web handling system shown in FIG. 11, the web handling system being shown transporting the web of material.

Referring now to FIGS. 11 and 12, web handling system 11 can be used in the following manner to transport a web of material 99 using a predefined, modifiable vacuum zone. Specifically, system 11 is preferably assembled onto a vertical support surface, or panel, (not shown). With system 11 mounted as such, the number and angular arrangement of magnetic elements 39 is selected to define the desired vacuum zone for rotating drum 29. In the present example, ten magnetic elements 39 are disposed in an end-to-end relationship to create a fixed wrap angle $\alpha$ (i.e., a defined vacuum region about its periphery) of approximately 90 degrees.

The location of magnetic elements 39 defines the region of contact, or suction, between drum 29 and web 99. Once the preferred orientation and angular arrangement of magnetic elements 39 is established, holder 37 is locked fixed in place on front mounting plate 15 using a pin or other similar fastening element.

As noted briefly above, motor 19 rotably drives main shaft 17 which, in turn, continuously rotably drives drum 29 about its longitudinal axis, as represented by arrow R in FIG. 12. Upon activation of the vacuum pump (not shown), a vacuum force is established through central vacuum line 21. Because vacuum line 21 is in direct communication with interior cavity 70 in end cap 31, the application of a vacuum force similarly draws a suction force through each vacuum channel 49 in fluid communication therewith.

It is important to note that, as drum 29 continuously rotates, magnetic elements 39 remain stationary and therefore only open valves 27 as they occupy an angular position in direct alignment therewith. By contrast, valves 27 that do not occupy angular positions in direct alignment with magnetic elements 39 are sealed closed, thereby blocking suction through its corresponding vacuum channel 49.

Accordingly, as seen most clearly in FIG. 12, when each closing member 33 occupies an angular position in direct alignment with the leading magnetic element 39-1, its corresponding valve 27 is rendered open, thereby drawing the underside of web 99 in contact with drum 29 through its corresponding vacuum channel 49. As drum 29 continues to rotate, the vacuum forces applied to the underside of web 99 rotably advances web 99 along a similar path. Once the same closing member 33 rotates beyond the last magnetic element 39-2, its corresponding valve 27 promptly closes, thereby releasing web 99 from drum 99. Accordingly, a predefined, fixed wrap angle $\alpha$ is established for roller 13, which is a principal object of the present invention.

As can be appreciated, the utilization of internal valves 27 to independently selectively control fluid communication through the plurality of vacuum paths 25 overcomes many of the various shortcomings that are traditionally associated with vacuum rollers that utilize a stationary baffle, or seal ring, to limit suction within a particular region. Specifically, the use of internal valves 27 minimizes air leakage and eliminates the creation of debris that is generally caused through the continuous friction established between a rotating drum and a stationary baffle.

Examples of Alternate Embodiments and Design Modifications

As referenced above, the embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

As an example, it should be noted that the location of each internal valve 27 could be modified within its associated vacuum path 25 without departing from the spirit of the present invention. For instance, each valve 27 could be alternatively disposed within a corresponding bore 51 in drum 29 rather than in end cap 31.

Figure 13:
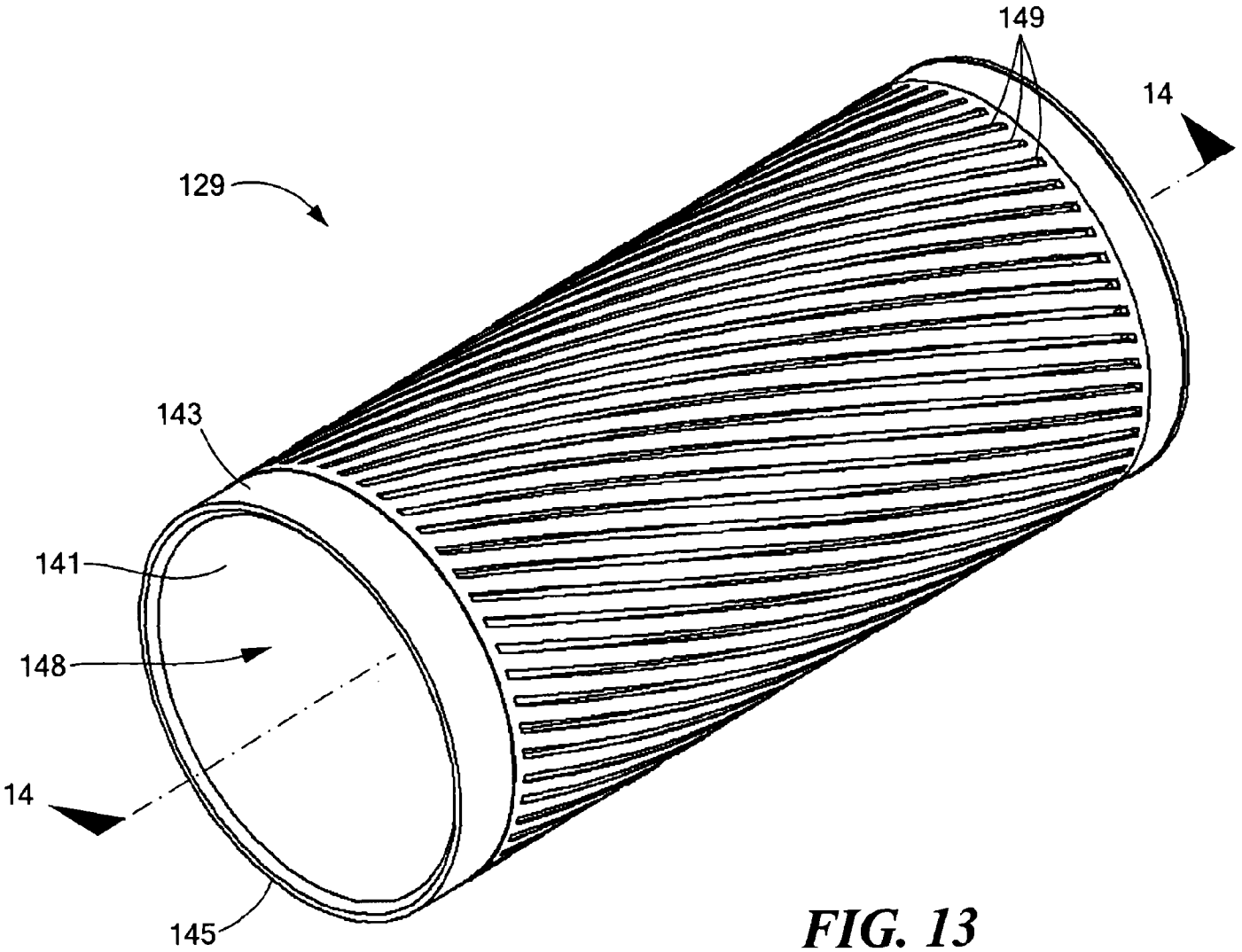
FIG. 13 is a top perspective view of a first modified version of the drum shown in FIG. 3.
Figure 14:
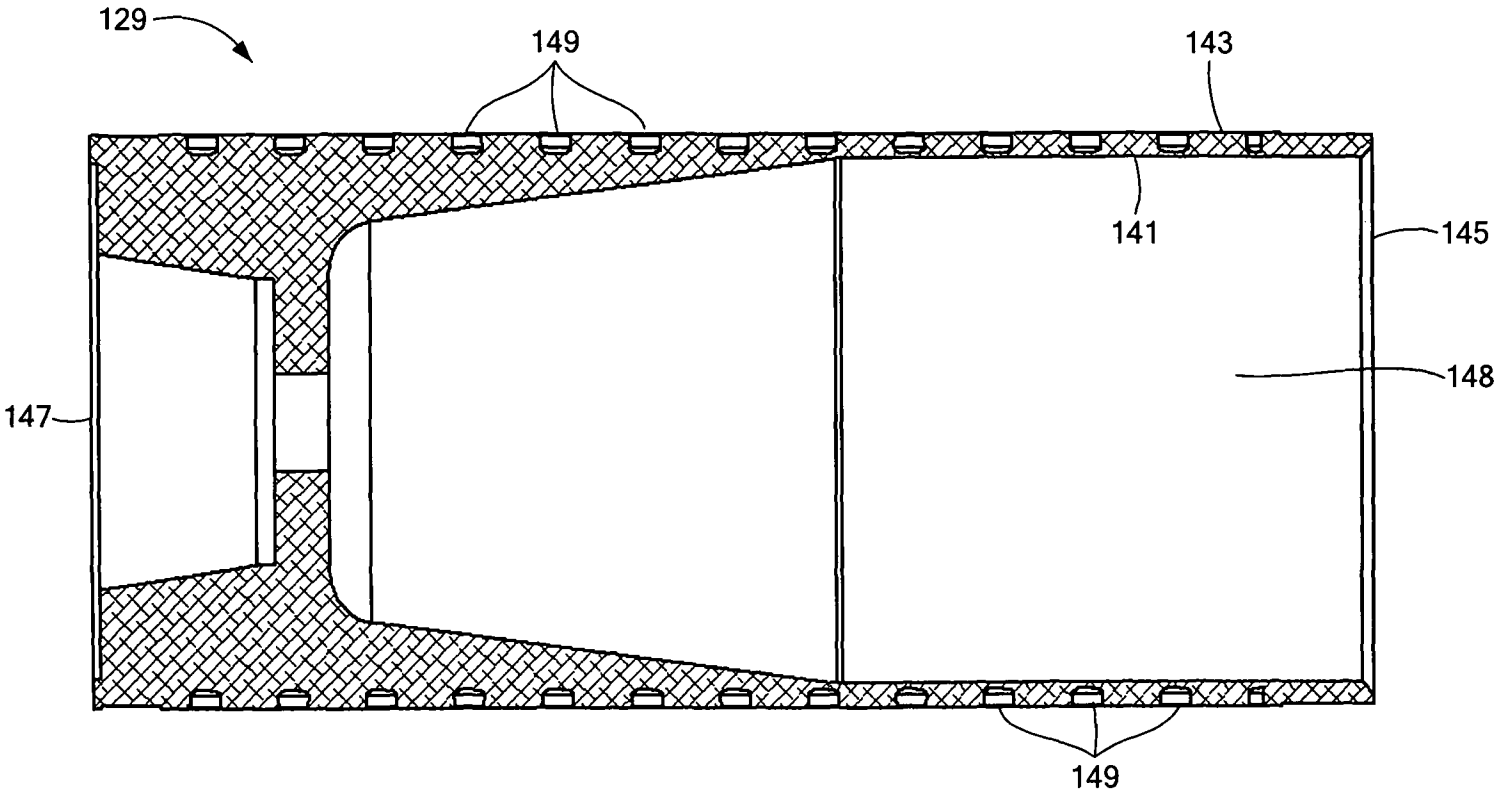
FIG. 14 is a section view of the drum shown in FIG. 13, taken along lines 14-14.

As another example, it should be noted that particular elements of the design of drum 29 could be modified without departing from the spirit of the present invention. Referring now to FIGS. 13 and 14, there is shown a first modified drum for use with vacuum roller 11, the drum being constructed according to the teachings of the present invention and identified generally by reference numeral 129. As can be seen, drum 129 is similar to drum 29 in that drum 129 is constructed as a generally cylindrical member that includes an interior surface 141, a rounded exterior surface 143, a substantially open front end 145 and a substantially enclosed rear end 147 that together define an enlarged interior cavity 148. Drum 129 is also similar to drum 29 in that drum 129 includes a plurality of longitudinally extending vacuum channels 149 that are formed into exterior surface 143 in an equidistantly spaced apart relationship.

Drum 129 differs primarily from drum 29 in the configuration of its vacuum channels 149. Specifically, vacuum channels 149 are provided with a more pronounced spiral configuration to promote less stress on the web during its initial suction thereto and, in turn, its subsequent release therefrom.

Figure 15:
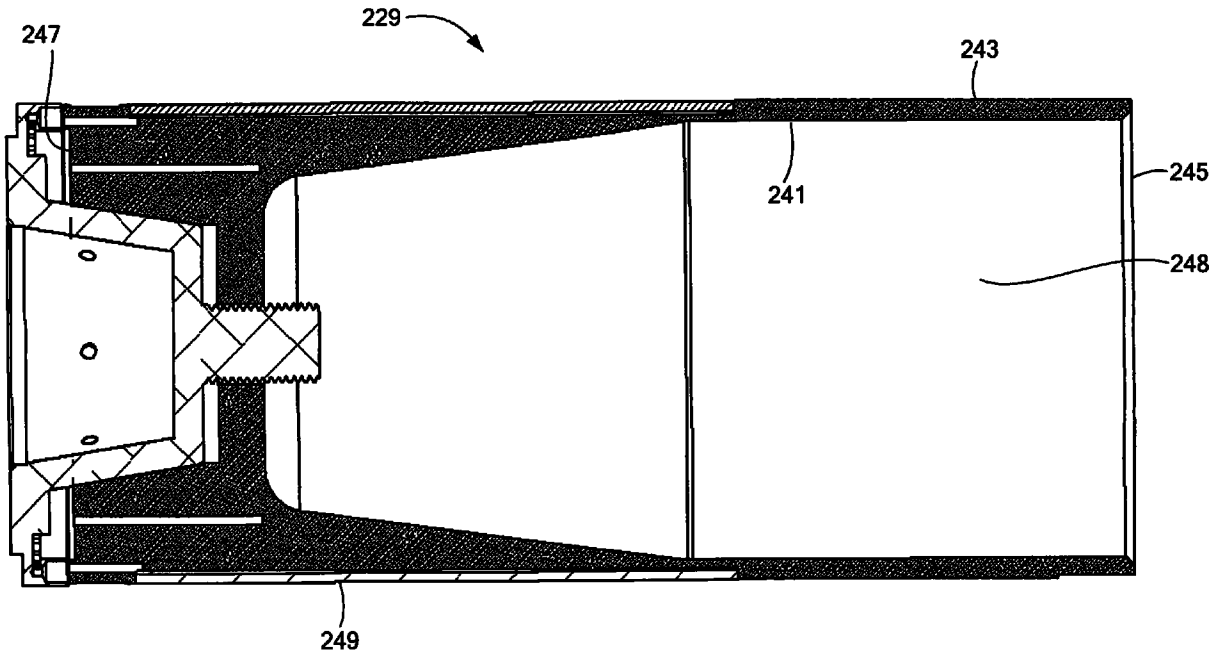
FIG. 15 is a longitudinal section view of the drum shown in FIG. 5, the drum being shown with porous material deposited in the outer portion of each vacuum channel, the drum additionally being shown with its associated end cap mounted thereon.
Figure 16:
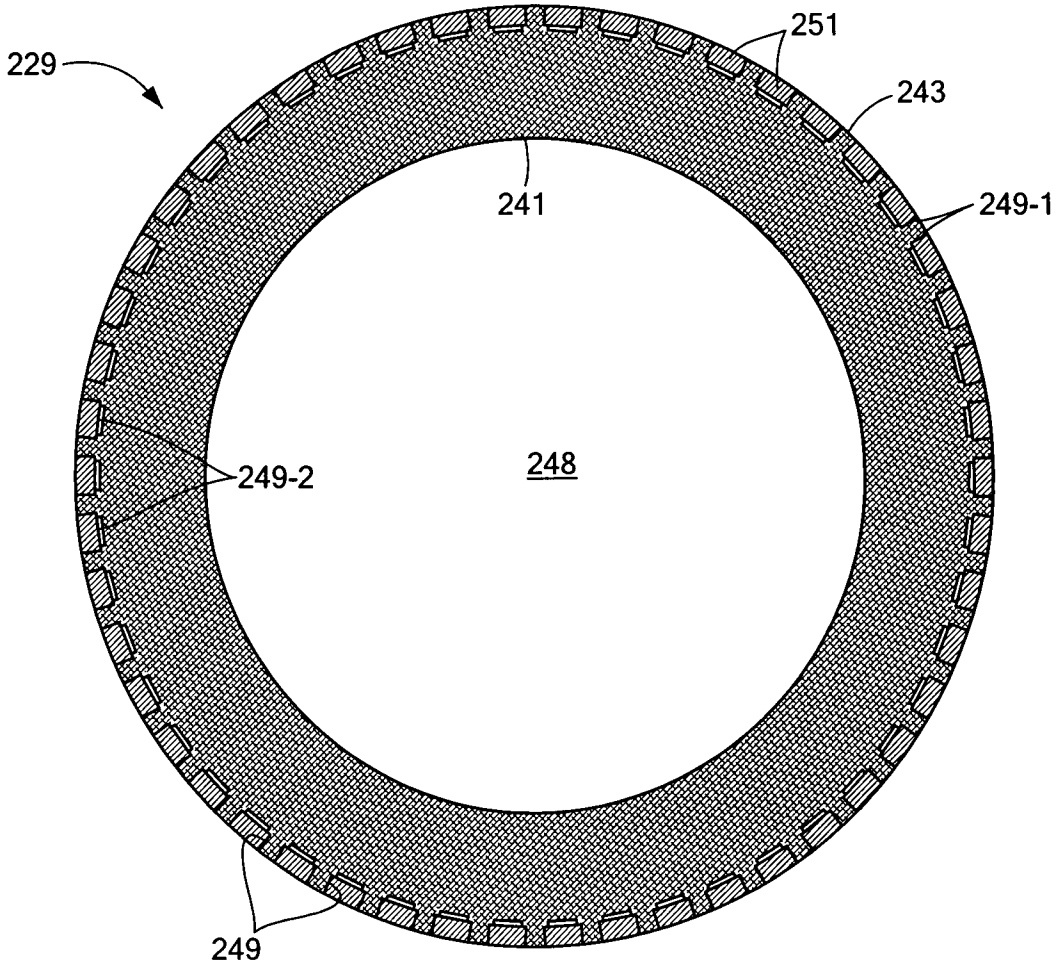
FIG. 16 is a transverse cross-section of the drum shown in FIG. 15.

Referring now to FIGS. 15 and 16, there is shown a second modified drum for use with vacuum roller 11, the drum being constructed according to the teachings of the present invention and identified generally by reference numeral 229. As can be seen, drum 229 is similar to drum 29 in that drum 229 is constructed as a generally cylindrical member that includes an interior surface 241, a rounded exterior surface 243, a substantially open front end 245 and a substantially enclosed rear end 247 that together define an enlarged interior cavity 248. Drum 229 is also similar to drum 29 in that drum includes a plurality of longitudinally extending vacuum channels 249 that are formed into exterior surface 243 in an equidistantly spaced apart relationship.

As seen most clearly in FIG. 16, the cross-section of each vacuum channel 249 is designed to prevent distortion of a thin web suctioned thereagainst, as will be explained further below. Specifically, each vacuum channel 249 includes an enlarged, widened outer portion 249-1 that is generally rectangular in transverse cross-section, outer portion 249-1 extending to the exterior surface 243 of drum 229. In addition, each vacuum channel 249 includes a narrow, reduced cross-section inner portion 249-2 that is disposed directly beneath its corresponding outer portion 249-1 in fluid communication therewith.

As shown, outer portion 249-1 of each vacuum channel 249 is preferably filled with a supply of porous metal 251. Accordingly, as vacuum forces are drawn through channel 249 (via inner portion 249-2), porous metal 251 provides support for a web drawn onto drum 229, thereby preventing the web from being pulled down into channel 249, which can otherwise result in its distortion (particularly for webs of limited thickness).

Figure 17:
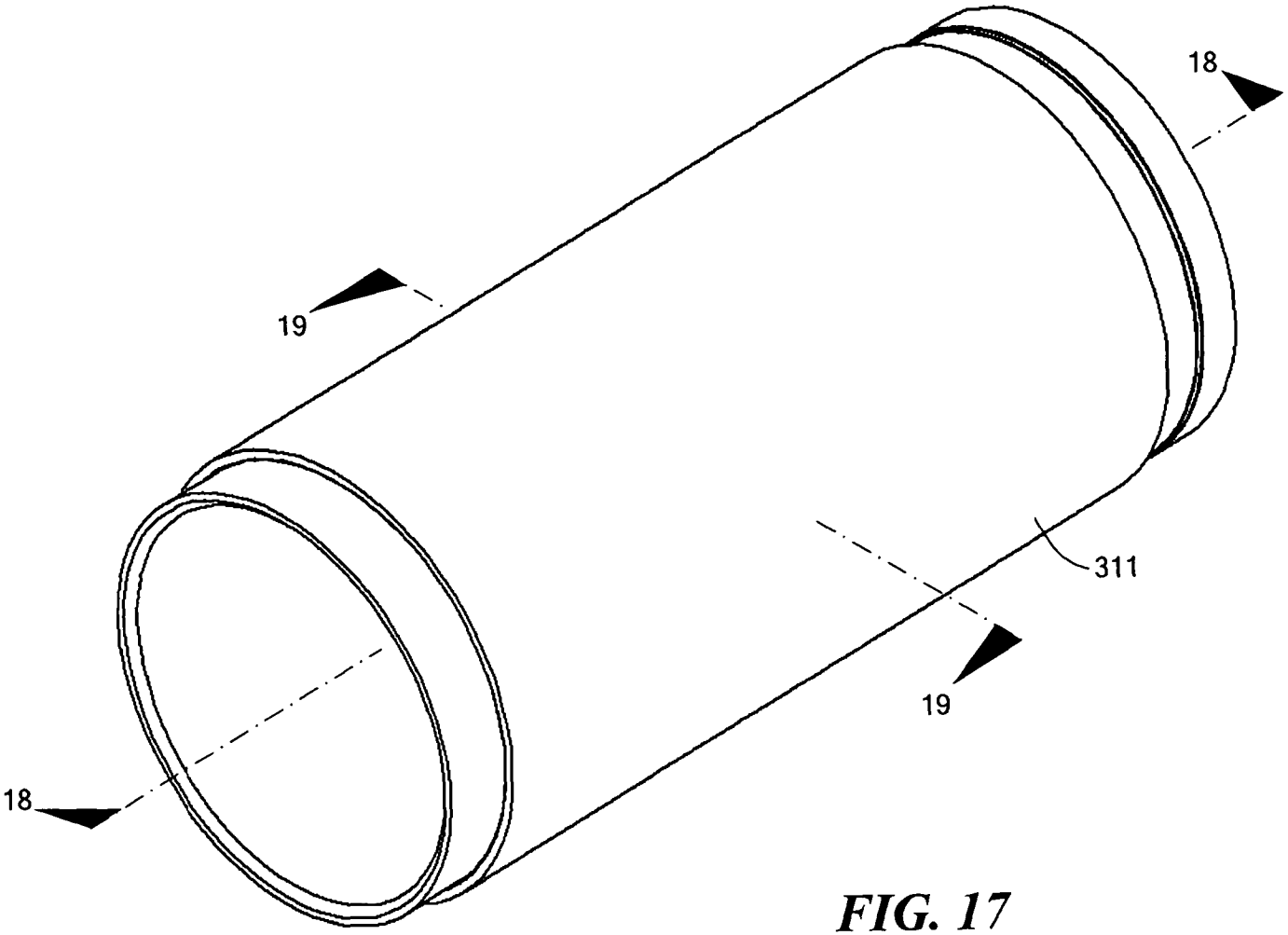
FIG. 17 is a top perspective view of a porous sleeve constructed according to the teachings of the present invention, the porous sleeve being shown mounted on the drum shown in FIG. 5, the drum additionally being shown with its associated end cap mounted thereon.
Figure 18:
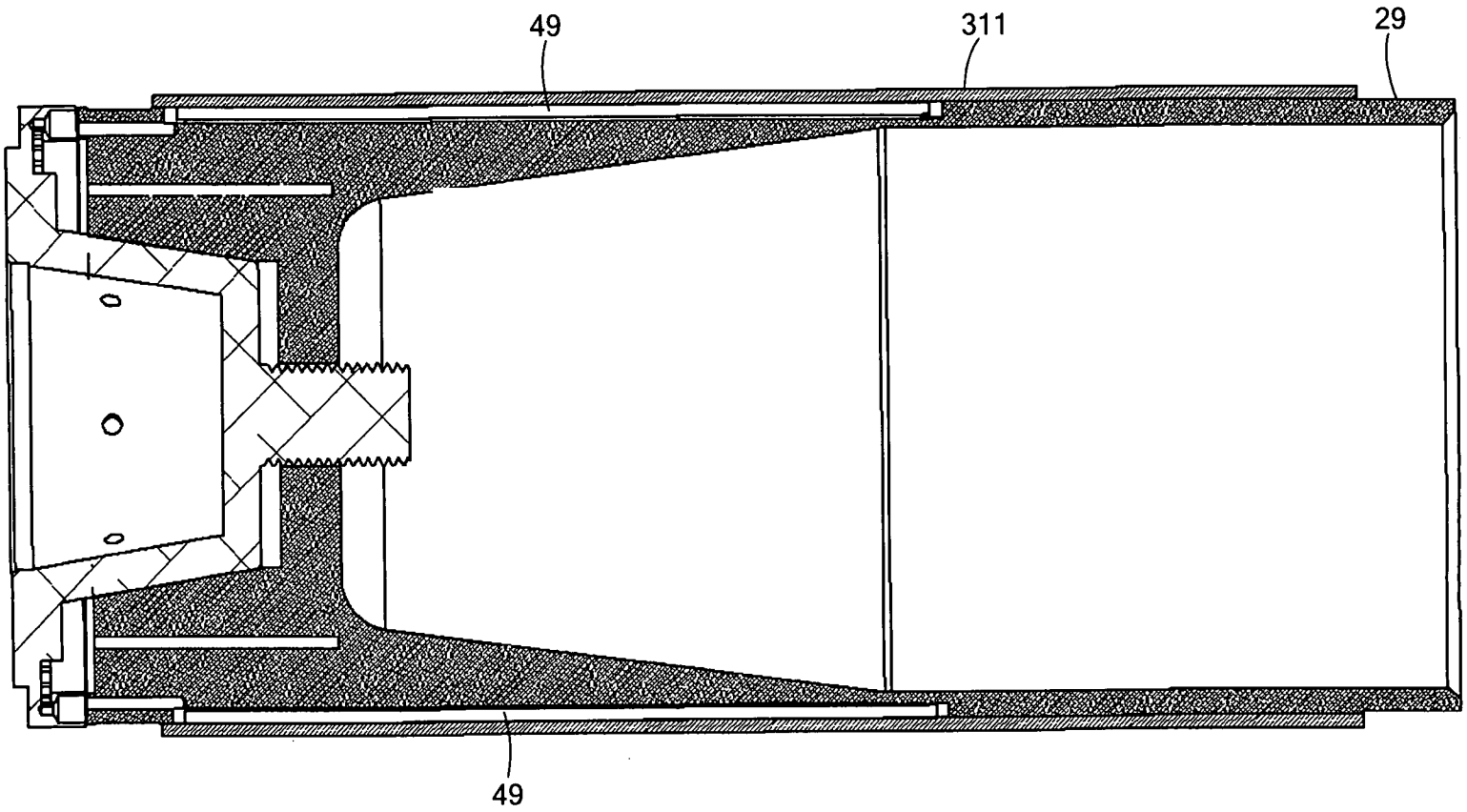
FIG. 18 is a longitudinal section view of the porous sleeve and drum shown in FIG. 17, taken along lines 18-18.
Figure 19:
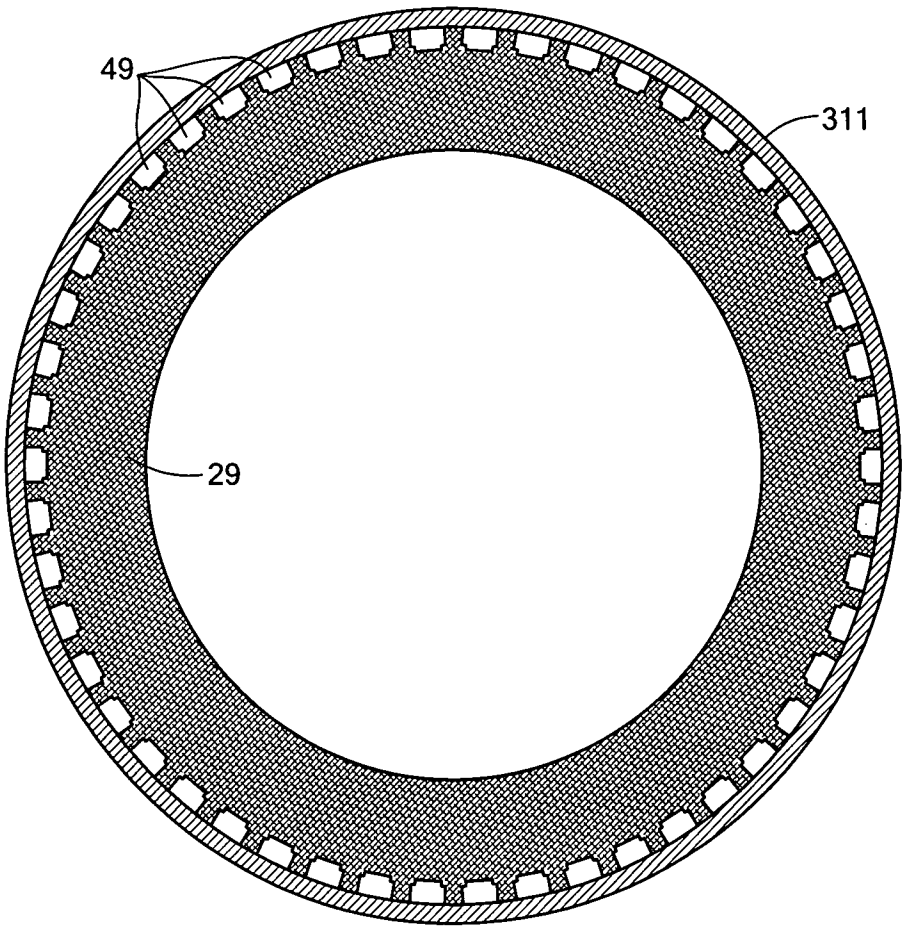
FIG. 19 is a transverse section view of the porous sleeve and drum shown in FIG. 17 taken along lines 19-19.

It should be noted that the present invention is not limited to the use of porous metal to limit web distortion. Rather, referring now to FIGS. 17-19, there is shown a porous sleeve for use with drum 29 to limit web distortion, the porous sleeve being constructed according to the teachings of the present invention and identified generally by reference numeral 311.

As can be seen, sleeve 311 is a unitary tubular member that is constructed of a porous material. Sleeve 311 is dimensioned to be fittingly slid over drum 29 in a telescopic relationship relative thereto. As such, sleeve 311 overlies vacuum channels 49 and provides a generally smooth web contact surface, which is highly desirable. Because sleeve 311 is constructed of a porous material, a suction force can still be drawn through sleeve 311 from the plurality of vacuum channels 49. However, the relative firmness and smooth contact surface of porous sleeve 311 minimizes the risk of any web distortion during its transport, which is highly desirable.

What is claimed is:

1. A vacuum roller for a web handling system, the vacuum roller comprising:

(a) a drum, the drum having an inner surface, an outer surface, a front end and a rear end, the drum being shaped to at least partially define a plurality of externally communicable vacuum paths;

(b) a plurality of movable elements, each movable element being disposed within an associated vacuum path and serving to regulate the passage of air therethrough, wherein each of the plurality of movable elements is metallic and is adapted for displacement between a first position and a second position, wherein air is at least substantially restricted from passing through its associated vacuum path when the movable element is disposed in its first position and air is permitted to freely pass through its associated vacuum path when the movable element is disposed in its second position; and (c) at least one stationary magnetic element for selectively displacing each movable element.

2. The vacuum roller as claimed in claim 1 wherein the movable element is naturally biased in its first position.

3. The vacuum roller as claimed in claim 1 wherein the movable element is a sphere.

4. The vacuum roller as claimed in claim 1 wherein the at least one stationary magnetic element is mounted on a rotatable annular holder.

5. The vacuum roller as claimed in claim 4 wherein a plurality of magnetic elements is mounted on the annular holder in an end-to-end arrangement.

6. The vacuum roller as claimed in claim 1 wherein the at least one stationary magnetic element selectively displaces each movable element from at least one of its first and second positions to the other of its first and second positions based on its proximity relative thereto.

7. The vacuum roller as claimed in claim 6 wherein the at least one stationary magnetic element selectively displaces each movable element from its first position to its second position.

8. The vacuum roller as claimed in claim 1 wherein a plurality of separate vacuum channels is formed into the outer surface of the drum, each vacuum channel defining a portion of a corresponding vacuum path.

9. The vacuum roller as claimed in claim 8 wherein each of the plurality of vacuum channels extends longitudinally along the outer surface of the drum and has a generally spiral configuration.

10. The vacuum roller as claimed in claim 8 further comprising a supply of porous metal that is deposited into each of the plurality of vacuum channels.

11. The vacuum roller as claimed in claim 8 further comprising a porous sleeve that is fittingly slid over the outer surface of the drum in a telescopic relationship relative thereto.

12. A vacuum roller for a web handling system, the vacuum roller comprising:

(a) a drum, the drum having an inner surface, an outer surface, a front end and a rear end, the drum being shaped to at least partially define a plurality of externally communicable vacuum paths;

(b) a plurality of movable elements, each movable element being disposed within an associated vacuum path and serving to regulate the passage of air therethrough, each of the plurality of movable elements is adapted for displacement between a first position and a second position, wherein air is at least substantially restricted from passing through its associated vacuum path when the movable element is disposed in its first position and air is permitted to freely pass through its associated vacuum path when the movable element is disposed in its second position; and (c) an end cap coupled to the drum, wherein the end cap and drum together define the plurality of vacuum paths, the end cap comprising, (i) a cup-shaped base, the base including an enclosed circular end wall and a continuous, outwardly tapered sidewall that extends rearwardly from the periphery of the enclosed end wall, (ii) an outwardly extending, annular flange formed about the periphery of the sidewall, and (iii) an annular collar formed onto the flange, the collar being shaped to define a circumferential array of equidistantly spaced apart axial bores, each bore defining a portion of a corresponding vacuum path.

13. The vacuum roller as claimed in claim 12 wherein at least one of the drum and the end cap is shaped to define an open neck within its corresponding vacuum path, the movable element being dimensioned to selectively enclose the open neck when disposed in its first position.

14. The vacuum roller as claimed in claim 12 wherein each movable element is disposed within a corresponding bore in the annular collar of the end cap.

* * * * *